US007762239B2

(12) United States Patent
Chisholm et al.

(10) Patent No.: US 7,762,239 B2
(45) Date of Patent: Jul. 27, 2010

(54) V-TYPE ENGINE WITH VALLEY-MOUNTED FUEL PUMP

(75) Inventors: Peter M. Chisholm, Macomb, MI (US); Timothy J. Knott, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 173 days.

(21) Appl. No.: 12/116,722

(22) Filed: May 7, 2008

(65) Prior Publication Data

US 2009/0277425 A1 Nov. 12, 2009

(51) Int. Cl.
*F02M 37/04* (2006.01)
*F02B 75/22* (2006.01)

(52) U.S. Cl. ..... 123/509; 123/54.4

(58) Field of Classification Search ..... 123/509, 123/504.4, 504.6, 504.7, 504.8, 198 C, 195 A
See application file for complete search history.

(56) References Cited

U.S. PATENT DOCUMENTS 2,681,050 A * 6/1954 Elwert ..... 123/41.74
2,882,884 A * 4/1959 Scheiterlein ..... 123/373
3,438,327 A * 4/1969 Thompson ..... 123/54.4
4,054,108 A * 10/1977 Gill ..... 123/54.4
4,080,945 A * 3/1978 Hikosaka et al. ..... 123/195 C
4,127,366 A * 11/1978 Sumi ..... 417/494
4,280,454 A 7/1981 Skinner
4,307,583 A 12/1981 Hall
4,535,652 A * 8/1985 Nishikawa et al. ..... 477/62
4,793,300 A 12/1988 Kadoshima et al.
5,007,806 A 4/1991 Bellis et al.
5,564,395 A * 10/1996 Moser et al. ..... 123/509
5,992,393 A * 11/1999 Yoshida et al. ..... 123/509
2004/0079320 A1 4/2004 Callini et al.
2009/0255514 A1 * 10/2009 Liedtke et al. ..... 123/509

FOREIGN PATENT DOCUMENTS

GB 2176238 12/1986
JP 4334753 11/1992

* cited by examiner

*Primary Examiner*—Mahmoud Gimie
(74) *Attorney, Agent, or Firm*—Julia Voutyras; Brooks Kushman P.C.

(57) ABSTRACT

A V-type engine with an engine block face extending upward on at least one end of the valley includes a plurality of fasteners having a first threaded portion engaging the face of the engine block and a second threaded portion extending through the face into the valley and through corresponding apertures in a fuel pump housing mounting flange of a fuel pump disposed within the valley to secure the fuel pump directly to the engine block face without an adapter plate. The second threaded portion of each fastener engages a complementarily threaded spacer with a proximate end securing the flange of the fuel pump housing to the back of the engine block face and extending into the valley along substantially the entire length of the fuel pump housing to a distal end shaped to facilitate engagement with a fastening tool.

13 Claims, 3 Drawing Sheets

V-TYPE ENGINE WITH VALLEY-MOUNTED FUEL PUMP

BACKGROUND

1. Technical Field

The present disclosure relates to a system and method for mounting a fuel pump in a V-type internal combustion engine.

2. Background Art

Engine compartments of automotive vehicles have grown increasingly crowded as more components are added to the engine to improve performance and reduce emissions. V-type engines may include one or more components located in the valley formed between the two cylinder banks to provide a compact engine package and various other advantages. However, machining of the cylinder block valley for mounting of components may be difficult or infeasible depending on the particular component and engine configuration. Prior art strategies, such as disclosed in U.S. Pat. No. 4,793,300 use a bracket or adapter plate secured to the cylinder block and component to secure the component to the cylinder block without machining in the valley.

SUMMARY

A multiple cylinder internal combustion engine having an engine block with first and second cylinder banks arranged at an angle relative to one another to form a valley therebetween with an engine block face extending upward on at least one end of the valley includes a plurality of fasteners having a first threaded portion engaging the face of the engine block and a second threaded portion extending through the face into the valley and through corresponding apertures in a fuel pump housing mounting flange of a fuel pump disposed within the valley to secure the fuel pump directly to the engine block face without an adapter plate. The second threaded portion of each fastener engages a complementarily threaded spacer with a proximate end securing the flange of the fuel pump housing to the back of the engine block face and extending into the valley along substantially the entire length of the fuel pump housing to a distal end having a polygonal shape to facilitate engagement with a fastener driver tool.

In one embodiment, a method for mounting a high-pressure fuel pump in the valley of a V-type internal combustion engine includes securing a plurality of threaded fasteners in a front face of an engine block such that a threaded portion of the fasteners extends through the face into the valley, positioning a fuel pump in the valley with a mounting flange having a plurality of mounting holes such that each of the plurality of fasteners extends through a corresponding mounting hole of the flange, and securing a threaded spacer to each fastener to secure the fuel pump directly to the back side of the front face of the engine block.

In another embodiment, a method for mounting a fuel pump on an internal combustion engine having a cylinder block with two cylinder banks disposed at an angle relative to one another forming a valley therebetween includes positioning the fuel pump in the valley between the cylinder banks such that a fuel pump drive shaft hub and drive shaft extends through an aperture in the front face of the cylinder block and the fuel pump housing contacts a back surface of the front face of the cylinder block, and securing the fuel pump to the back surface of the front face using a plurality of fasteners extending through corresponding holes in the front face and through a mounting flange of the fuel pump housing.

The present disclosure includes embodiments having various advantages. For example, embodiments of the present disclosure provide improved packaging by mounting a high-pressure fuel pump in the valley of a V-type engine. The mounting strategy of the present disclosure reduces part count and complexity by eliminating an adapter plate or bracket that would otherwise be needed to mount the fuel pump due to the difficulty of machining in the valley of the engine block. The present disclosure provides direct mounting of the fuel pump to the back side of the engine block face so that the fuel pump is disposed within the valley without requiring machining of mounting holes from within the valley. Use of a spacer/nut extending into the valley along the fuel pump housing to a distal end shaped for engagement with a fastening tool provides accessibility to the spacer/nut to facilitate assembly and any subsequent servicing of the fuel pump.

The above advantages and other advantages and features will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to a V-type turbocharged, four-stroke, multi-cylinder, direct-injected compression-ignition internal combustion engine with a camshaft disposed within the engine block and a pushrod valvetrain. Those of ordinary skill in the art may recognize similar applications or implementations consistent with the present disclosure for other engine technologies, including spark-ignition engines of various configurations, for example. As used herein, words of direction including, but not limited to, forward, rearward, upward, front, back, etc. generally refer to the orientation of an engine mounted under the hood in the front portion of a passenger vehicle and are used for ease of illustration and description of representative embodiments. Those of ordinary skill in the art will recognize that the teachings of the present disclosure may be applied to other applications or implementations where the engine may be installed toward the rear of the vehicle, under a cab, or at some angle or orientation other than vertical for example, and that the words of direction should be adapted or modified accordingly for those applications consistent with the teachings herein.

Figure 1:
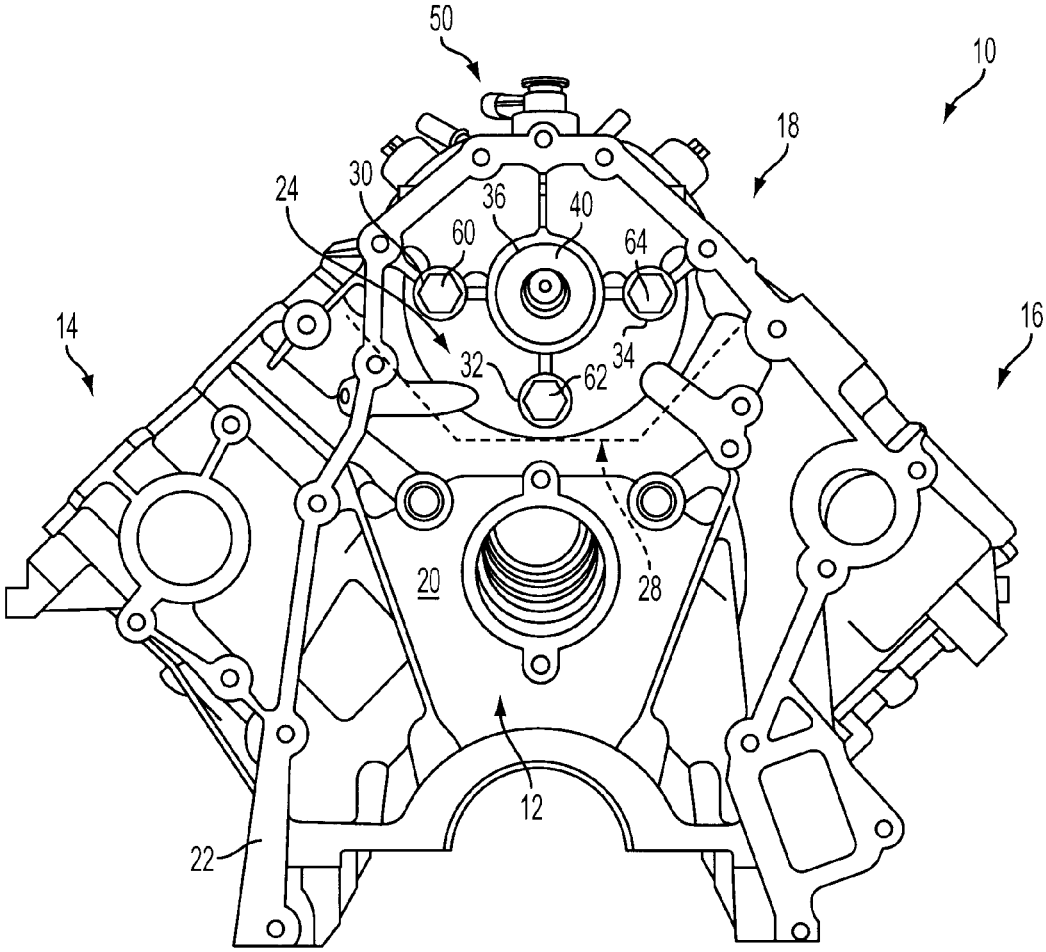
FIG. 1 is a front view of a V-type internal combustion engine block with a high-pressure fuel pump disposed in the valley and directly mounted to the back side of a front face of the engine block according to one embodiment of the present disclosure.

One representative embodiment of a V-type multiple cylinder internal combustion engine having a fuel pump disposed in the valley and directly mounted to the engine block according to the present disclosure is illustrated in the front view of FIG. 1. System 10 includes an engine block (or cylinder block) 12 having a first cylinder bank 14 and a second cylinder bank 16 arranged at an angle relative to one another, typically referred to as a "V" configuration or "V-type" engine. The space disposed generally between cylinder banks 14, 16 having a floor represented generally by dotted line 28 is also known as the valley 18 of the engine (best illustrated in FIGS. 2-3). While illustrated and described with respect to an eight-cylinder diesel pushrod engine with a camshaft disposed within the engine block and a ninety-degree angle between cylinder banks 14, 16, the present disclosure is not limited to a particular number of cylinders, angle between the cylinder banks 14, 16, or the representative engine technology. Those of ordinary skill in the art may recognize other engine configurations in which various features of the present disclosure may be used to advantage.

Cylinder block 12 includes a front portion or face 20 having a generally flat front surface 22 adapted to receive a front engine cover (not shown). Front face 20 extends generally upward crossing a floor of the valley, indicated generally by reference numeral 28 (best illustrated in FIGS. 2, 3), between first cylinder bank 14 and second cylinder bank 16 at one end. Front face 20 includes various areas 24 recessed relative to front surface 22. Recessed area 24 includes a plurality of fuel pump mounting holes extending through corresponding bosses 30, 32, and 34, which are disposed about a central aperture 36 adapted to receive a fuel pump alignment hub 40 (best illustrated in FIGS. 3, 4). Fuel pump 50 is disposed within valley 18 of engine block 12 directly behind front face 20. A plurality of threaded fasteners 60, 62, 64 extend through corresponding holes in bosses 30, 32, 34, respectively, into valley 18 and through a mounting flange of the fuel pump housing (FIGS. 3-5) to secure fuel pump 50 to engine block 12. Fasteners 60, 62, and 64 may be any suitable fasteners to provide a clamping force between the pump housing and front face 20. In one embodiment, each fastener 60, 62, and 64 is implemented by a bolt and spacer nut as illustrated and described with reference to FIG. 5.

Figure 2:
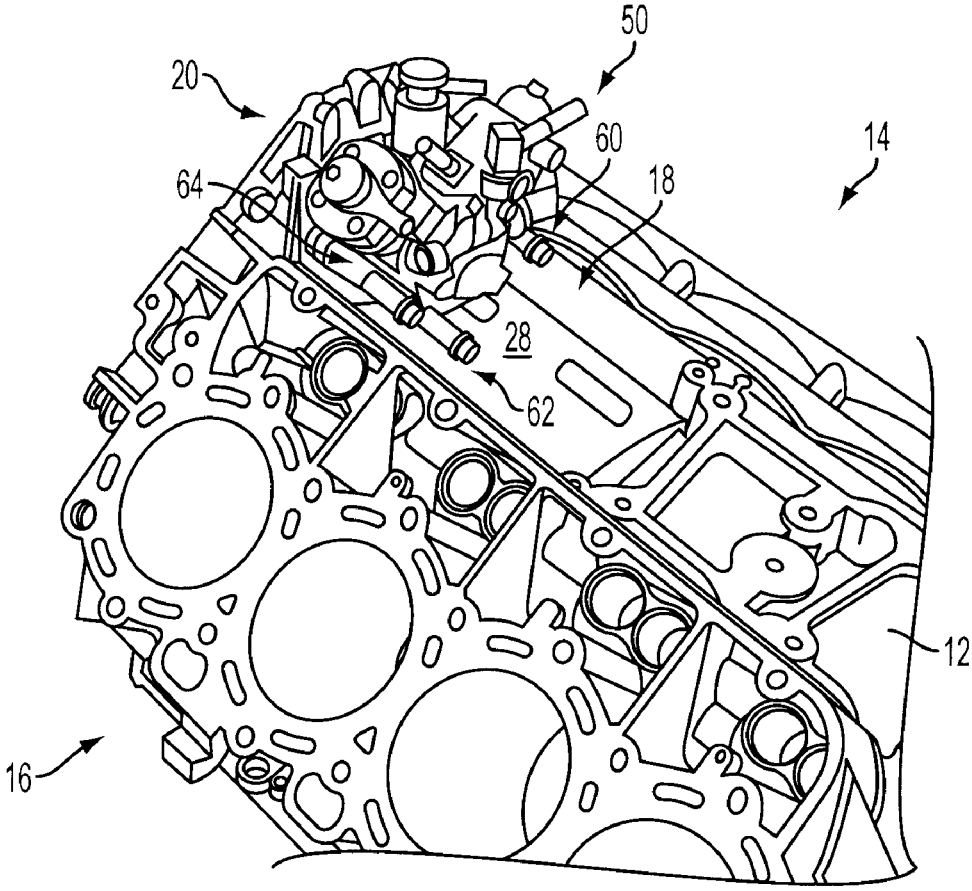
FIG. 2 is a perspective view from the back side of the front face of a cylinder block illustrating a high-pressure fuel pump mounted in the valley of a V-type internal combustion engine according to one embodiment of the present disclosure.

FIG. 2 is a perspective view from the back side of the front face of a cylinder block illustrating a high-pressure fuel pump 50 mounted in the valley of a V-type internal combustion engine according to one embodiment of the present disclosure. As shown in FIG. 2, front face 20 of cylinder block 12 extends generally upward from or across floor 28 at one end of valley 18. Fuel pump 50 is disposed within valley 18 generally between cylinder banks 14, 16, each of which has four cylinders in this representative embodiment. As shown in FIGS. 2-5, fuel pump 50 includes a housing having an integral mounting flange 70 that contacts a back surface of engine block face 20. Fuel pump housing flange 70 includes a plurality of apertures corresponding in number and location to the plurality of fasteners 60, 62, 64 such that the fasteners extend through flange 70 to facilitate installation and any subsequent servicing of fuel pump 50. As shown in FIG. 2, in one embodiment, fasteners 60, 62, and 64 extend along substantially the entire length of the fuel pump housing to provide tool access to the distal end of each fastener. Depending upon the particular application and implementation, the fasteners may extend beyond fuel pump 50 as shown in FIG. 2, or may be slightly recessed as shown in FIG. 4, but still accessible by a fastener tool, such as a socket wrench, for example.

Figure 3:
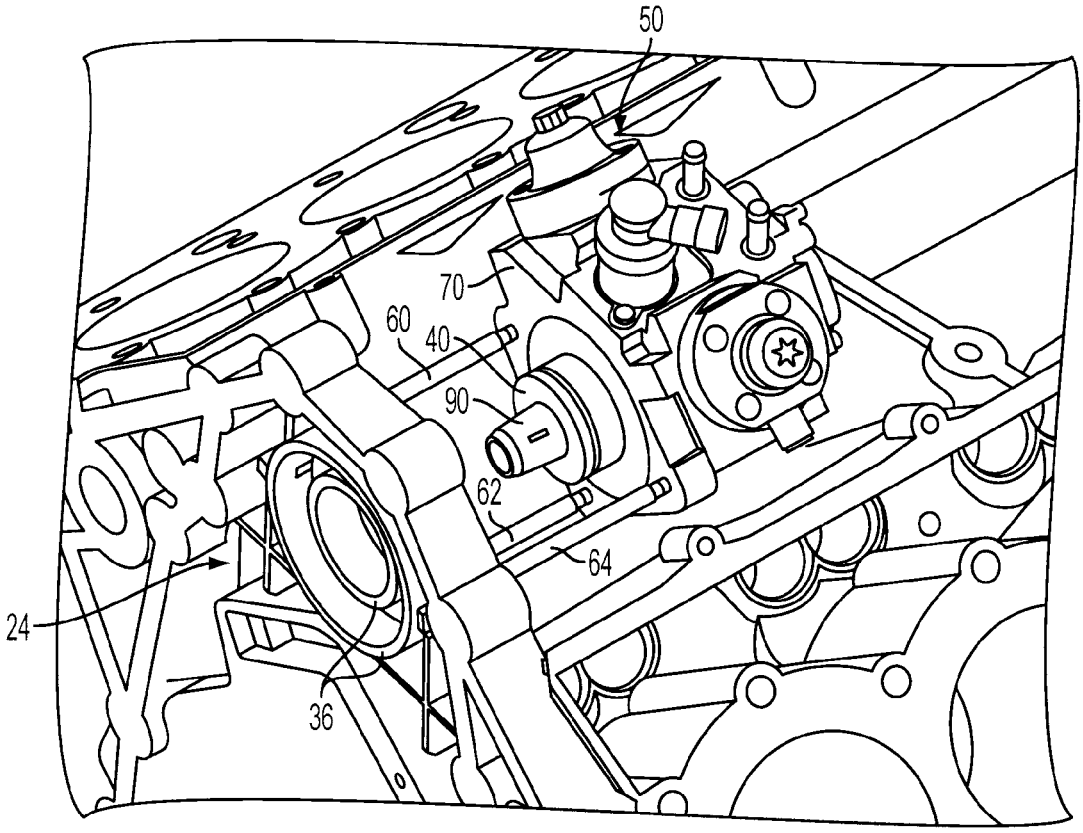
FIG. 3 is a perspective view from a front, top angle illustrating installation of a high-pressure fuel pump in the valley of a V-type engine according to embodiments of the present disclosure.
Figure 4:
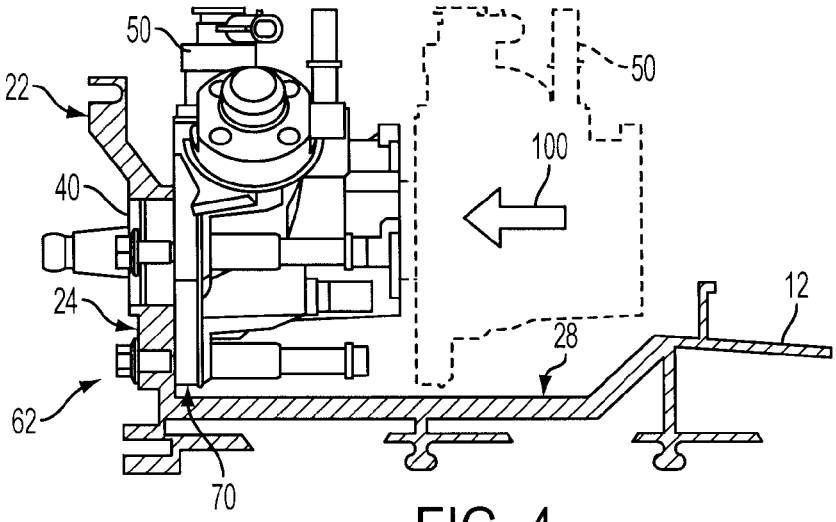
FIG. 4 is a partial cross-sectional view illustrating a system or method for directly mounting a fuel pump to an engine block in the valley of a V-type engine according to embodiments of the present disclosure.

FIGS. 3 and 4 illustrate a representative embodiment of a method for securing a fuel pump directly to an engine block according to the present disclosure. FIG. 3 is a perspective view from a front, top angle illustrating installation of a high-pressure fuel pump in the valley of a V-type engine according to embodiments of the present disclosure while FIG. 4 is a partial cross-sectional view illustrating a system or method for directly mounting a fuel pump to an engine block in the valley of a V-type engine according to the present disclosure.

Figure 5:
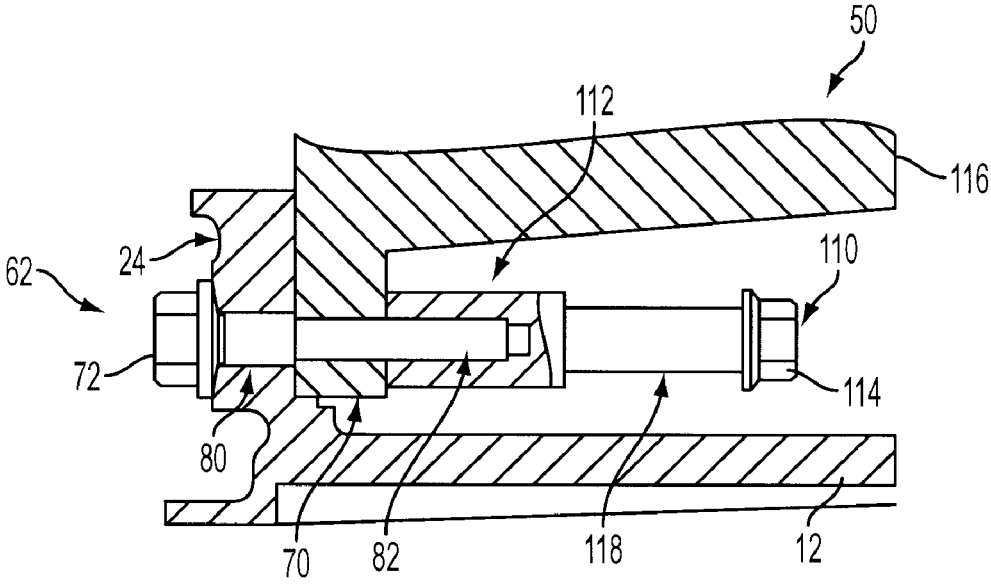
FIG. 5 is a partial cross-sectional view illustrating a fastener and spacer nut for use in a representative embodiment of a system or method for directly mounting a fuel pump to an engine block in the valley of a V-type internal combustion engine according to the present disclosure.

In the embodiment of FIG. 3, fasteners 60, 62, and 64 extend through corresponding holes in the recessed area 24 of front face 20 into valley 18. As shown in FIG. 5, each fastener may include a bolt having a first threaded portion 80 of a first diameter that is rotated to engage a corresponding threaded hole in recessed area 24 such that a second threaded portion 82 of a second diameter extends through the hole and into valley 18. Fuel pump 50 is positioned in valley 18 between cylinder banks 14, 16 such that mounting holes in the fuel pump housing mounting flange are aligned with fasteners 60, 62, 64 and fuel pump 50 is moved toward front face 20 as generally indicated by arrow 100 (FIG. 4). Fuel pump drive shaft 90 and alignment hub 40 extend through aperture 36 in front face 20 of cylinder block 12, and the fuel pump housing mounting flange 70 contacts a back surface of front face 20 of cylinder block 12. Each fastener 60, 62, 64 may have a corresponding spacer nut 110 having an internally threaded first (proximate) end 112 extending to a polygonal distal end 114 to facilitate engagement of the distal end with a driver tool, such as a wrench (not shown) for example. In the illustrated embodiments, distal end 114 is hexagonal to facilitate engagement with a socket wrench, for example. Other geometries may be provided such as square, star, etc. depending upon the particular application and implementation. Spacer nut 110 is rotated so that the internally threaded first end 112 engages a corresponding threaded portion 82 of fastener 62 to apply a clamping force between the fuel pump housing and front face 20 of cylinder block 12 to secure fuel pump 50 to cylinder block 12.

FIG. 5 is a partial cross-sectional view illustrating a fastener and spacer nut for use in a representative embodiment of a system or method for directly mounting a fuel pump to an engine block in the valley of a V-type internal combustion engine according to the present disclosure. Those of ordinary skill in the art may recognize various alternative fasteners, studs, lugs, etc. for directly mounting a fuel pump to the cylinder block in the valley consistent with the teachings of the present disclosure. In the embodiment of FIG. 5, fastener 62 is implemented by a hex-head bolt 72 having a first threaded portion 80 of a first diameter for engaging a corresponding threaded hole in the front recessed portion 24 of cylinder block 24. Bolt 72 also includes a second threaded portion 82 having a second diameter smaller than the first diameter that extends through fuel pump housing flange 70. A spacer nut 110 includes a first end 112 internally threaded to engaged second threaded portion 82 of bolt 72 and exert a clamping force on flange 72 of the pump housing and front recessed portion 24 of cylinder block 12. Second (terminal or distal) end 114 includes a nut spaced from first end 112 such that nut 114 extends beyond at least half the axial length of fuel pump housing 116 to facilitate wrench accessibility of nut 114. In the fastener embodiment illustrated in FIG. 5, internally threaded portion 112 of spacer nut 110 is connected by a solid shaft portion 118 extending between threaded portion 112 and polygonal distal end 114. As such, solid portion 118 effectively spaces polygonal end 114 from internally threaded portion 112 to provide wrench accessibility of polygonal end 114 after installation in valley 18.

As illustrated and described herein, embodiments according to the present disclosure provide improved packaging by mounting a high-pressure fuel pump in the valley of a V-type engine. The mounting strategy of the present disclosure reduces part count and complexity by eliminating an adapter plate or bracket that would otherwise be needed to mount the fuel pump to the engine block due to the difficulty of machining in the valley of the engine block. The present disclosure provides direct mounting of the fuel pump to the back side of the cylinder block face so that the fuel pump is disposed within the valley and does not require machining of mounting holes within the valley. Use of a spacer nut extending into the valley along the fuel pump housing to a distal end shaped for engagement with a fastener driver tool or wrench provides accessibility to the spacer nut to facilitate assembly and any subsequent servicing of the fuel pump.

While the best mode has been described in detail, those familiar with the art will recognize various alternative designs and embodiments within the scope of the following claims. Where one or more embodiments have been described as providing advantages or being preferred over other embodiments and/or over prior art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not outside the scope of the invention as claimed.

What is claimed:

1. A multiple cylinder internal combustion engine comprising:

an engine block having first and second cylinder banks arranged in a V configuration forming a valley therebetween, the engine block including a face extending generally upward at one end of the valley;

a plurality of threaded fasteners extending through the face of the engine block into the valley;

a fuel pump disposed within the valley, the fuel pump including a housing having an integral flange with a plurality of apertures corresponding in number and location to the plurality of fasteners such that the fasteners extend through the apertures and the housing flange contacts a back surface of the engine block face; and a plurality of threaded spacers having a proximate end engaging a corresponding threaded fastener and securing the flange of the fuel pump housing directly to the back surface of the engine block face.

2. The engine of claim 1 wherein each of the threaded fasteners includes a threaded portion that engages a corresponding threaded hole in the engine block face.

3. The engine of claim 1 wherein each of the threaded fasteners includes a first threaded portion that engages a corresponding threaded hole in the engine block face and a second threaded portion that engages a corresponding one of the threaded spacers.

4. The engine of claim 1 wherein each of the plurality of threaded spacers extends from the proximate end to a distal end adapted to facilitate engagement of the distal end with a driver tool.

5. The engine of claim 4 wherein each of the plurality of threaded spacers extends along substantially the entire length of the fuel pump housing to provide tool access to the distal end.

6. The engine of claim 4 wherein the distal end is hexagonal to facilitate engagement with a socket wrench.

7. The engine of claim 1 wherein each of the plurality of threaded spacers includes an internally threaded portion terminating at the proximate end and connected to a solid portion extending between the threaded portion and a distal end adapted for engagement with a driver tool.

8. A method for mounting a fuel pump on an internal combustion engine having a cylinder block with two cylinder banks disposed at an angle relative to one another forming a valley therebetween, the method comprising:

positioning the fuel pump in the valley between the cylinder banks such that a fuel pump drive shaft extends through an aperture in the front face of the cylinder block and the fuel pump housing contacts a back surface of the front face of the cylinder block;

securing the fuel pump to the back surface of the front face using a plurality of fasteners extending through corresponding holes in the front face and through a mounting flange of the fuel pump housing;

wherein securing the fuel pump includes rotating each fastener such that a first threaded portion engages a corresponding threaded hole in the face of the cylinder block and a second threaded portion extends through the mounting flange of the fuel pump housing; and securing a threaded spacer to each fastener to apply a clamping force between the fuel pump housing and the front face of the cylinder block to secure the fuel pump to the cylinder block.

9. The method of claim 8 wherein each threaded spacer comprises an integrally formed spacer of unitary construction having an internally threaded hole in one end connected to a solid shaft portion that terminates in a polygonal shape at an opposite end to facilitate engagement with a driver tool.

10. The method of claim 8 further comprising:

securing a plurality of fasteners in corresponding threaded holes of the front face of the cylinder block such that the fasteners extend into the valley before positioning the fuel pump in the valley.

11. The method of claim 10 wherein positioning the fuel pump in the valley comprises aligning holes in an integral mounting flange of the fuel pump housing with the plurality of fasteners extending into the valley such that each fastener extends through the flange when the housing contacts the back surface of the front face of the cylinder block.

12. A system for mounting a fuel pump to a V-type internal combustion engine, the system comprising:

a cylinder block having a plurality of cylinders divided into first and second cylinder banks disposed at an angle to one another and defining a valley extending generally between the first and second cylinder banks, the cylinder block having a front portion extending generally past a floor of the valley between the first and second cylinder banks at one end and including a generally flat surface adapted to receive a front cover, the front portion including an area recessed from the flat surface with a plurality of holes extending therethrough and disposed about a central aperture adapted to engage a fuel pump drive shaft hub;

a fuel pump having a housing including a mounting flange with a plurality of mounting holes disposed about a drive shaft hub, the fuel pump disposed within the valley such that the mounting flange of the housing contacts, and is secured to, a back surface of the front portion of the cylinder block;

a plurality of fasteners each including:

a bolt having a first threaded portion of a first diameter for engaging a threaded hole in the front portion of the cylinder block and a second threaded portion of a second diameter extending through the mounting flange; and a spacer nut having a first end internally threaded to engage the second threaded portion of a corresponding bolt and exert a clamping force on the mounting flange of the pump housing and the front portion of the cylinder block, and a second end having a nut spaced from the first end such that the nut extends beyond at least half the axial length of the fuel pump housing to facilitate accessibility of the nut.

13. The system of claim 12 wherein the internally threaded portion of the spacer nut extends less than half the entire length of the spacer nut.

* * * * *